US008973417B2

(12) United States Patent
Bench et al.

(10) Patent No.: US 8,973,417 B2
(45) Date of Patent: Mar. 10, 2015

(54) ELECTRONICALLY-CONTROLLED REMOVABLE CORE LOCK

(75) Inventors: James Bench, Roanoke, VA (US); Lance Schoell, Radford, VA (US); Doug Trent, Roanoke, VA (US); David Smith, Troutville, VA (US)

(73) Assignee: Medeco Security Locks, Inc., Salem, VA (US)

( * ) Notice: Subject to any disclaimer, the term of this patent is extended or adjusted under 35 U.S.C. 154(b) by 252 days.

(21) Appl. No.: 13/548,383

(22) Filed: Jul. 13, 2012

(65) Prior Publication Data

US 2013/0014552 A1 Jan. 17, 2013

Related U.S. Application Data

(60) Provisional application No. 61/508,248, filed on Jul. 15, 2011.

(51) Int. Cl.

| | |
|---|---|
| ***E05B 49/00*** | (2006.01) |
| ***E05B 9/08*** | (2006.01) |
| ***E05B 47/06*** | (2006.01) |
| *E05B 47/00* | (2006.01) |
| *E05B 35/08* | (2006.01) |

(52) U.S. Cl.

CPC ..... *E05B 9/086* (2013.01); *E05B 47/0673* (2013.01); *E05B 2047/0017* (2013.01); *E05B 35/08* (2013.01); *E05B 47/0012* (2013.01)

USPC ..... 70/278.7; 70/278.1; 70/278.3; 70/368; 70/371; 70/375

(58) Field of Classification Search

USPC ..... 70/277, 278.1, 278.2, 278.3, 278.7, 70/283, 283.1, 279.1, 421, 386, 416, 417, 70/367–369, 371, 375, 379 R, 381

See application file for complete search history.

(56) References Cited

U.S. PATENT DOCUMENTS

| | | | | |
|---|---|---|---|---|
| 4,789,859 | A * | 12/1988 | Clarkson et al. | 340/5.65 |
| 5,823,027 | A * | 10/1998 | Glick et al. | 70/278.2 |
| 6,334,347 | B1 * | 1/2002 | Iscla | 70/278.3 |
| 6,374,653 | B1 * | 4/2002 | Gokcebay et al. | 70/278.3 |
| 6,412,321 | B1 * | 7/2002 | Aramburu et al. | 70/278.3 |
| 6,564,601 | B2 * | 5/2003 | Hyatt Jr. | 70/278.3 |
| 6,604,394 | B2 | 8/2003 | Davis | |
| 6,668,606 | B1 * | 12/2003 | Russell et al. | 70/278.3 |
| 6,826,935 | B2 * | 12/2004 | Gokcebay et al. | 70/278.3 |
| 6,840,072 | B2 * | 1/2005 | Russell et al. | 70/278.3 |
| 6,895,792 | B2 | 5/2005 | Davis | |
| 7,316,140 | B2 * | 1/2008 | Russell et al. | 70/278.3 |
| 7,845,202 | B2 * | 12/2010 | Padilla et al. | 70/371 |
| 7,870,769 | B2 * | 1/2011 | Andersson | 70/278.7 |
| 8,276,414 | B2 * | 10/2012 | Luo | 70/278.7 |
| 8,534,102 | B2 * | 9/2013 | Andersson | 70/278.7 |
| 8,544,303 | B2 * | 10/2013 | Andersson | 70/278.7 |
| 2007/0289346 | A1 * | 12/2007 | Hyatt, Jr. | 70/283 |
| 2013/0152646 | A1 * | 6/2013 | Field | 70/283 |

FOREIGN PATENT DOCUMENTS

EP 1746229 A2 1/2007

* cited by examiner

*Primary Examiner* — Suzanne Barrett

(74) *Attorney, Agent, or Firm* — Rothwell, Figg, Ernst & Manbeck PC

(57) ABSTRACT

An electronic small format interchangeable core ("SFIC") lock is configured so that core locking features are electronically controlled, and keys can be electronically programmed to operate either as a normal user key able to open the lock or as a control key able to open the lock and to remove the SFIC cores. The same key will operate as a normal access key or as a control key, depending on how the key is programmed.

15 Claims, 13 Drawing Sheets

ELECTRONICALLY-CONTROLLED REMOVABLE CORE LOCK

PRIORITY CLAIM

This application claims the benefit under 35 U.S.C. §119 (e) of U.S. Provisional Application No. 61/508,248, filed Jul. 15, 2011, the disclosure of which is hereby incorporated by reference in their entirety.

FIELD OF THE INVENTION

This invention relates to interchangeable core locks and to electronically-controlled interchangeable locks.

BACKGROUND OF INVENTION

Small format interchangeable core (SFIC) locks are widely known in the industry. The concept allows mechanical cylinders to be removed from lock housings by the use of a specially bitted mechanical control key and re-installed into different housings. This can be done quickly and eliminates the need to have the mechanical cylinders rekeyed or re-pinned.

A feature of the mechanical SFIC lock is a control element, such as a control sleeve, that includes features that selectively lock the lock within a housing, such as a radial projection, or lug, that extends into a groove formed on the interior of the locking housing to engage the interchangeable cylinder core into the locking housing and lock the cylinder in place. When a properly bitted control key is inserted into the keyway of the interchangeable core and rotated, the control sleeve is rotated with the plug of the cylinder core into a retracted position to withdraw the projection from the groove and release the interchangeable core from the lock housing, thereby allowing the core to be removed from the lock housing. Keys bitted for normal access at the SFIC lock are able to rotate the cylinder plug and open the lock but are not able to rotate the control sleeve with the plug.

When developing an electronic SFIC lock retrofit for existing SFIC housings, a feature must be provided to allow the same function of inserting and removing SFIC cores. That is, a control element and means for actuating the control element must be provided so that the SFIC lock can be locked within and removed from the lock housing.

One SFIC electronic cylinder is described in U.S. Pat. No. 6,604,394. The core described in the '394 patent includes a control sleeve that is blocked from retracting by a spring biased blocking pin. Removal of the core requires a specially-shaped control key that has an extension on the key tip that, when the key is inserted into the cylinder, extends into the cylinder and raises the blocking pin out of the path of the control sleeve and allows the control sleeve to rotate in conjunction with the plug of the lock core to a retracted position. Normal access keys lack the extension on the key tip, and thus do not engage the control sleeve blocking pin when used to open the SFIC electronic cylinder. Like the normal access keys, the special control key must be programmed for access to the SFIC electronic cylinder in order to rotate the plug, but the engagement with the control sleeve is entirely a function of the mechanical portion of the key tip. No key programming is provided to differentiate the control key from the normal access key.

This mechanical approach to controlling rotation of the control sleeve represents a critical security flaw. Any normal access key programmed to operate the SFIC electronic cylinder could be used, in conjunction with picking tools able to raise the control sleeve blocking pin, to remove the core and leave the door unsecured. While the key and lock audit would capture the opening of the cylinder, there would be no subsequent audit of entries while the cylinder was removed from the door.

SUMMARY OF THE INVENTION

According to one aspect of the invention an electronic SFIC lock is configured so that the core locking features are electronically controlled, and keys can be electronically programmed to operate either as a normal user key or as a control key able to remove the SFIC cores. Thus, the same key will operate as a normal access key or as a control key, depending on how the key is programmed.

Because the control key is specially programmed, an audit event is captured and stored indicating that the core was removed.

Aspects of the invention embody a method for the electronic SFIC lock to operate normally in response to the presentation of a user key or to respond to the presentation of the electronic control key to facilitate the removal of the core from the housing.

DETAILED DESCRIPTION OF THE INVENTION

An electronic SFIC lock embodying aspects of the invention includes a microcontroller and a motor that controls access by controlling operation of the lock. A key provides power and communication with the cylinder. The key and cylinder exchange secure communications as part of the authentication process to determine if the user is allowed access. The motor is coupled to a blocking actuator that controls a side bar that is engageable with a groove formed within the SFIC shell. When the side bar is engaged with the groove, it prevents rotation of the cylinder plug within the shell. When the cylinder core is presented with a properly authenticated key, the motor is activated to move the blocking actuator, so that the side bar can disengage from the groove, and the key can be used to rotate the cylinder plug.

In normal operations the motor-controlled blocking actuator and side bar interference are all that are required to allow or prevent the rotation of the cylinder plug to the unlocked position.

In accordance with aspects of the invention, the motor provides a secondary function. The secondary function of the motor and actuator allows removal of the cylinder core from the housing based on electronic signals from a properly authenticated control key.

In accordance with one embodiment of the lock, when the microcontroller receives the secure authentication message from the electronic control key to request release of the cylinder core from the housing, the microcontroller first causes the motor to drive the blocking actuator in a first direction to release the side bar so that it can be disengaged from the locking groove and thereby allow the user to rotate the cylinder core in the direction of unlock. The microcontroller then activates the motor in such a manner as to couple the control element to the cylinder plug, so that rotation of the plug moves the control element from a first position locking the core with respect to the housing (i.e., a core locking or lock position) to a second position releasing the lock core with respect to the housing (i.e., a core releasing or release position). In one embodiment, the microcontroller reverses the direction of the motor to drive a secondary element of the motor actuator, a control pin actuator, in the opposite direction. The secondary element of the motor actuator pushes down a control pin inside the cylinder plug (and rotatable with the cylinder plug) to extend it outward toward a control pin hole in an outer portion of the control sleeve. When the control pin is engaged with the control sleeve, by rotating the cylinder until the control pin is aligned with the control pin hole, the motor actuator pushes the control pin into the control pin hole, thereby coupling the control sleeve to the plug. The control sleeve can then be rotated, along with the plug, to the retracted position. With the control sleeve refracted, the cylinder core can be removed from the housing.

Figure 1:
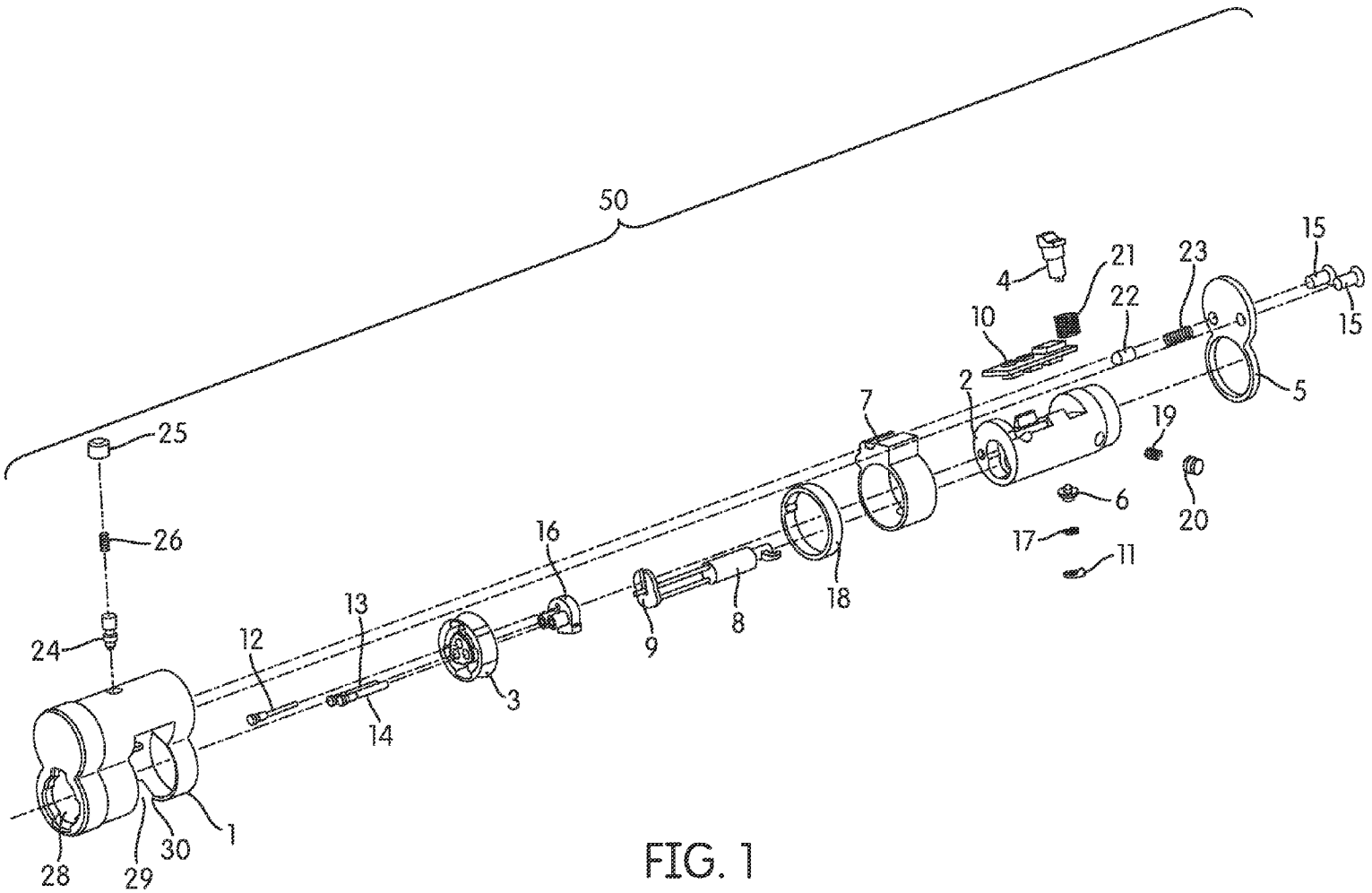
FIG. 1 is an exploded perspective view of an electronically-controlled removable core lock embodying aspects of the present invention.
Figure 2:
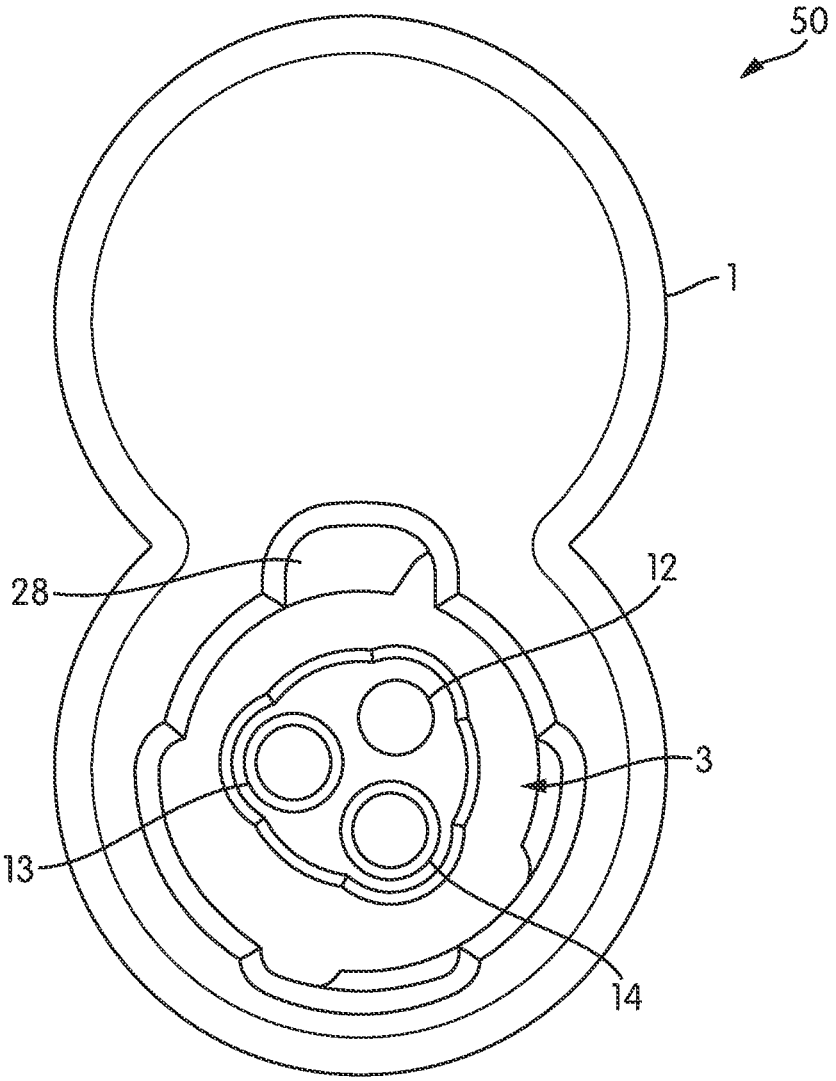
FIG. 2 is a front-end view of the removable core lock with a locking lug of a control sleeve in a retracted position (key not shown for clarity).

FIG. 1 shows an exploded perspective view of an electronically-controlled removable core lock 50 embodying aspects of the invention. Lock 50 includes a plug 2 disposed within a lower portion of a shell 1. A printed circuit board (PCB) assembly 10, which includes the microcontroller, is disposed in a top portion of the plug 2. The microcontroller of the lock 50 may comprise a microprocessor in communication with memory, such as electronically erasable programmable read only memory (EEPROM), and is associated with functions related to the operation of the lock and a corresponding key, such as, comparing information, executing algorithms to effect operation of the lock, and storing information relating to authorization codes (e.g., control or access credentials), passwords, lock activation events (e.g., audit events, such as entry and core removal), and other data. The microcontroller may also include access control reader that receives signals from a key or other device. The signals may comprise authentication codes (e.g., access and/or control credentials) and may be received either via wires, or other conductors, or wirelessly.

Figure 10:
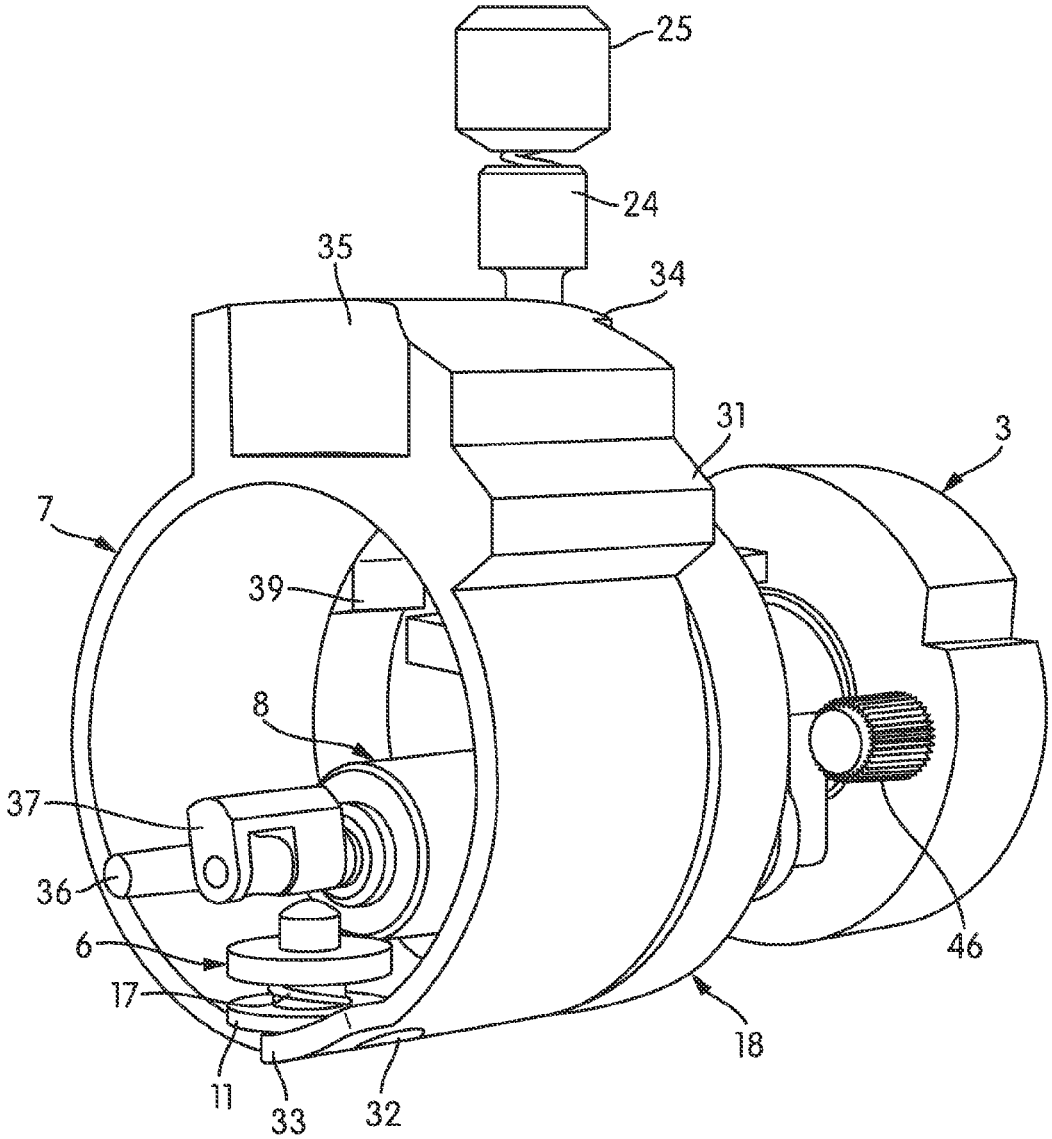
FIG. 10 is a rear perspective view with the shell, plug, and side bar omitted and showing the control sleeve in an extended position.
Figure 12:
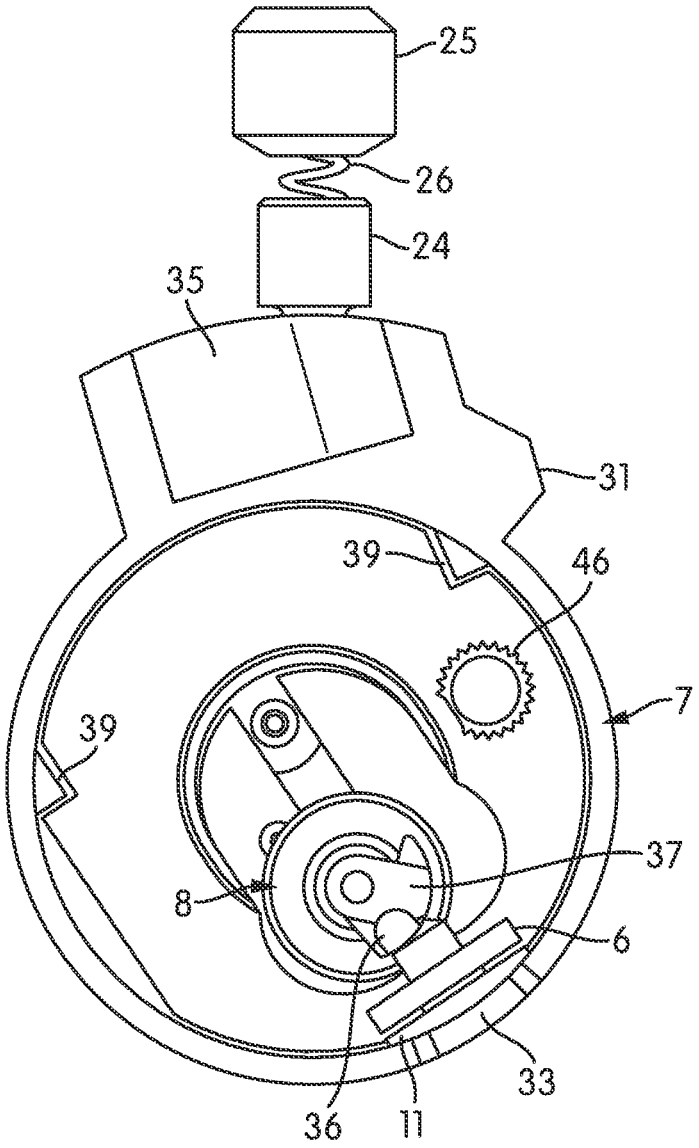
FIG. 12 is a rear-end view with the shell, plug, and side bar omitted, showing the control sleeve in a retracted position.
Figure 13:
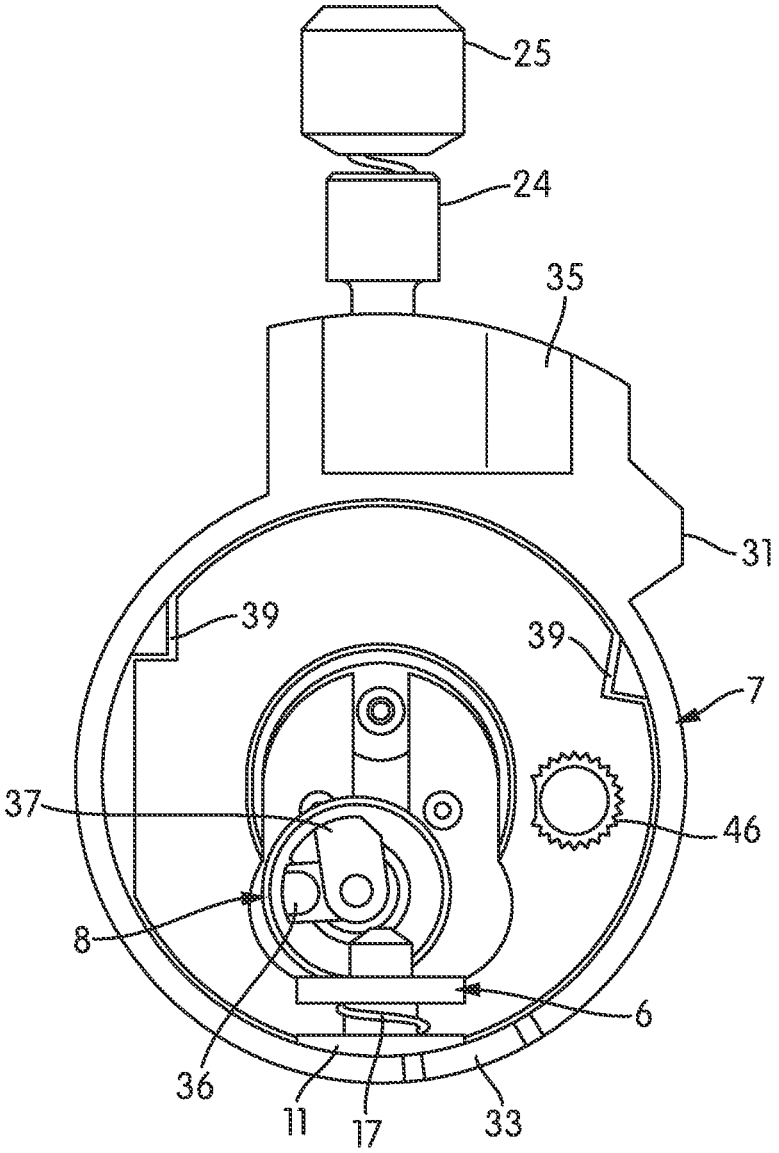
FIG. 13 is a rear-end view with the shell, plug, and side bar omitted, showing the control sleeve in an extended position.

The plug 2 includes a hollowed out portion that receives a motor assembly 8. A plug front 3 is disposed on a front end of the plug 2, and a contact housing 16, holding contact elements 12, 13, and 14, is disposed within the plug front 3 and is attached to the plug front 3. The plug front 3 is rotationally coupled to the plug 2 by a splined button 46 (see FIGS. 10 and 12) that is pressed into a hole formed in the plug 2. A drill plate 9 is disposed between the plug front 3 and the motor assembly 8. A latch pin control collar 18 and a control sleeve 7 are disposed within the shell 1, and the plug 2 extends through the collar 18 and sleeve 7. The plug front 3, motor assembly 8, collar 18, control sleeve 7, and plug 2 are retained within the shell 1 by a plug retainer plate 5 that is secured to the shell 1 by means of screws 15.

The plug 2 is coupled to a door latch or deadbolt mechanism via a cam or a tailpiece (not shown). A side bar 4, that is radially biased by spring 21, is disposed within a rear end of the plug 2. The removable core assembly 50 is secured within a lock housing by a control element that can be selectively moved between a core lock position and a core release position. In one embodiment, the control element comprises the control sleeve 7, which is electronically controlled in accordance with aspects of the present invention.

Figure 4:
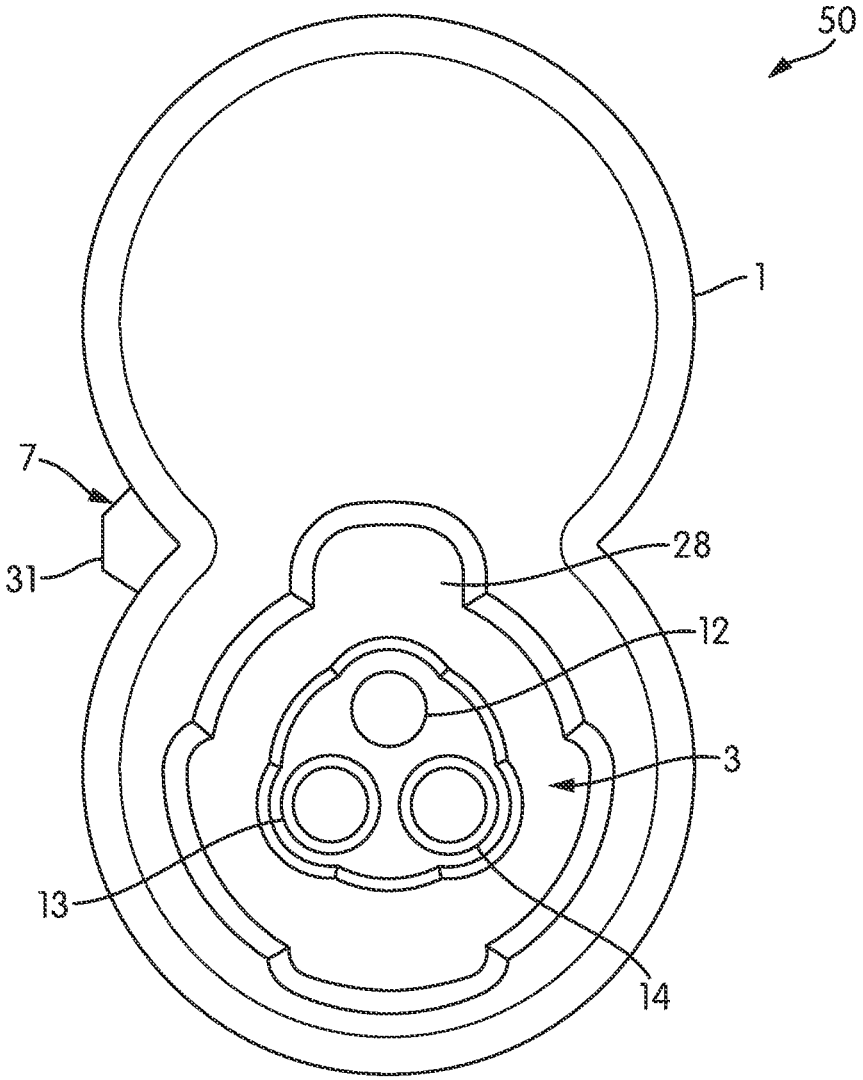
FIG. 4 is a front-end view of the lock with the control sleeve in an extended position.
Figure 5:
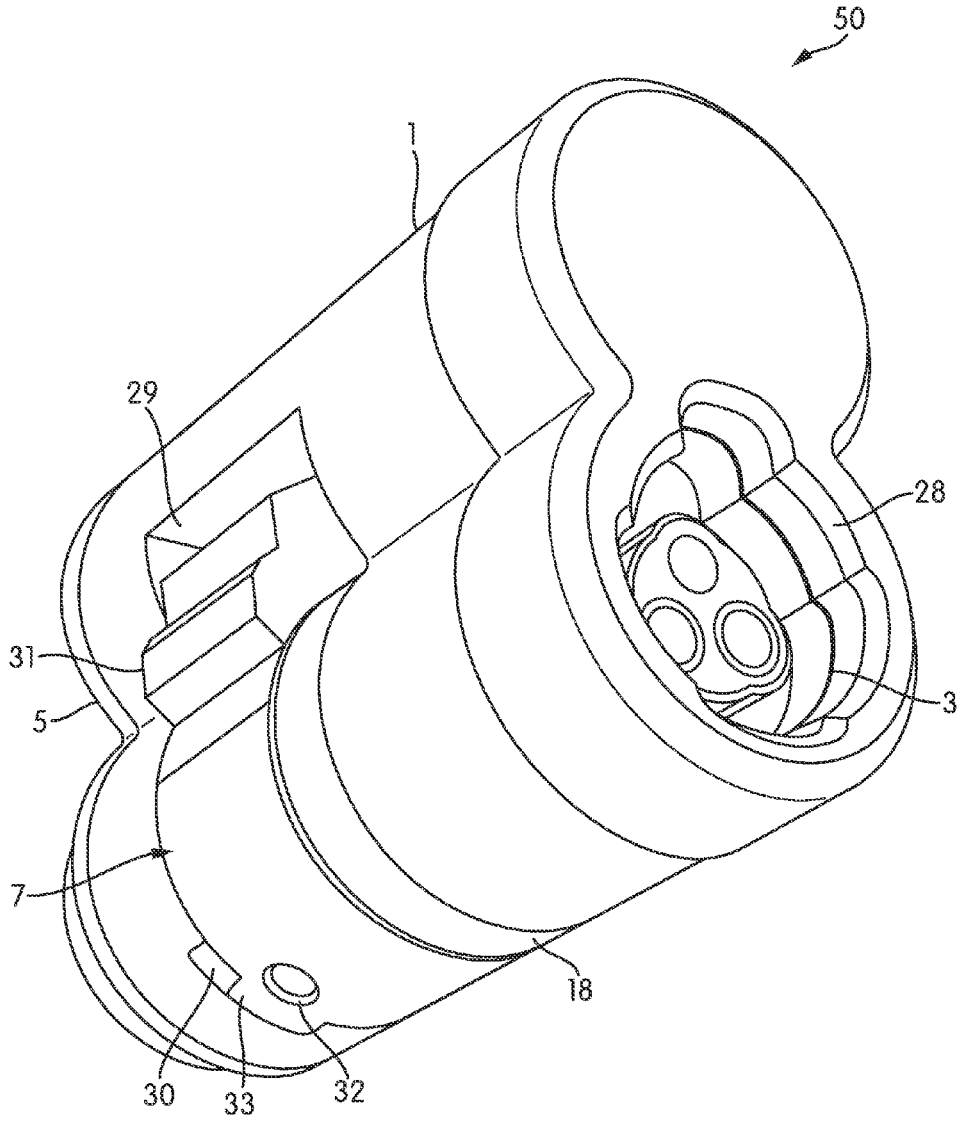
FIG. 5 is a bottom perspective view of the lock with the control sleeve in an extended position.

As shown in FIGS. 8-13, the control sleeve 7 includes a locking lug 31 that extends from a control sleeve slot 29 (see FIG. 1) formed in the shell 1. The removable core assembly 50 is secured within a housing when the control element is in the core lock position, for example, when the control sleeve 7 is in an extended position so that the locking lug 31 of the control sleeve projects from the shell 1 as shown in FIGS. 4 and 5. To remove the removable core assembly 50 from the housing, the control element must be moved from its core lock position to its core release position. In the illustrated embodiment, the control sleeve 7 is rotated to withdraw the locking lug 31 into the shell, thereby moving the control sleeve 7 from its core lock position to its core release position, thus permitting the lock assembly 50 to be removed from the housing.

Figure 8:
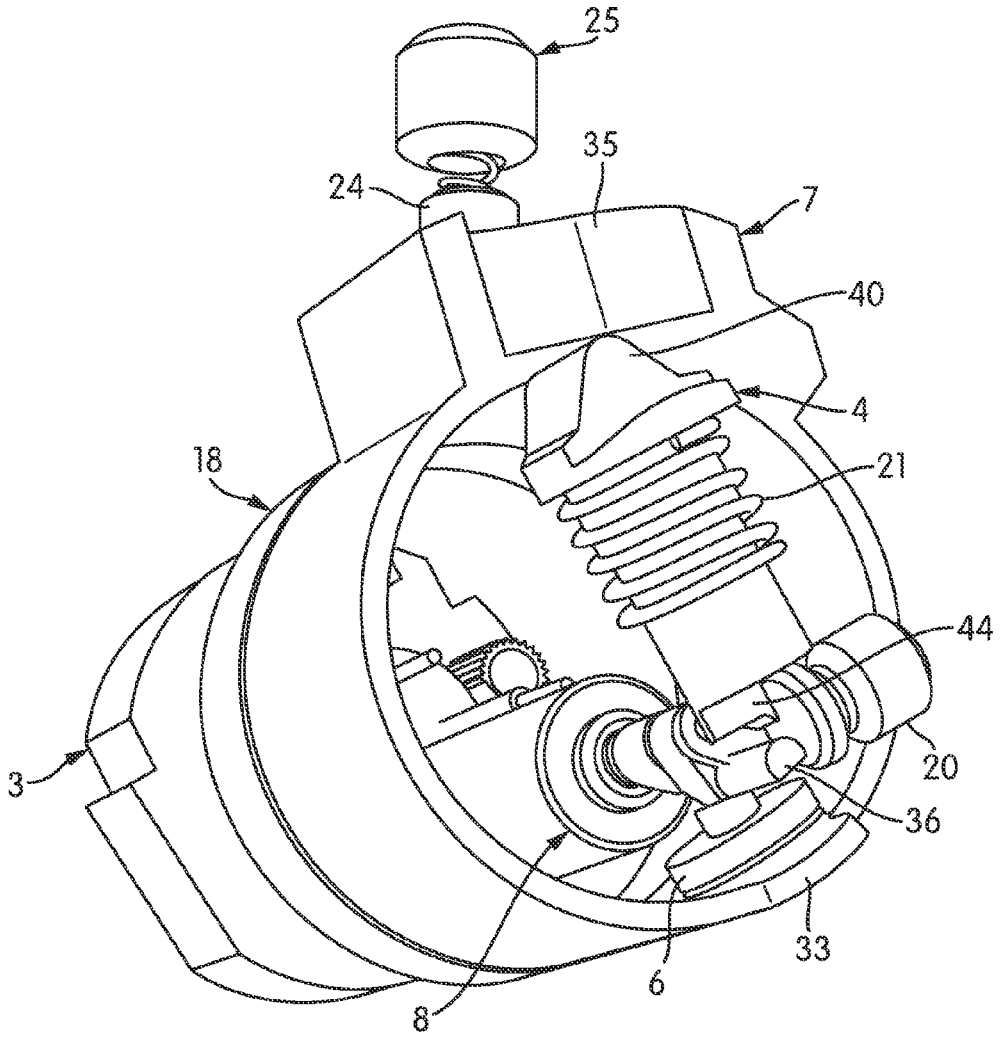
FIG. 8 is a rear perspective view of the lock with the shell and the plug omitted showing the control sleeve in a retracted position and showing the side bar in an unlocked position.
Figure 9:
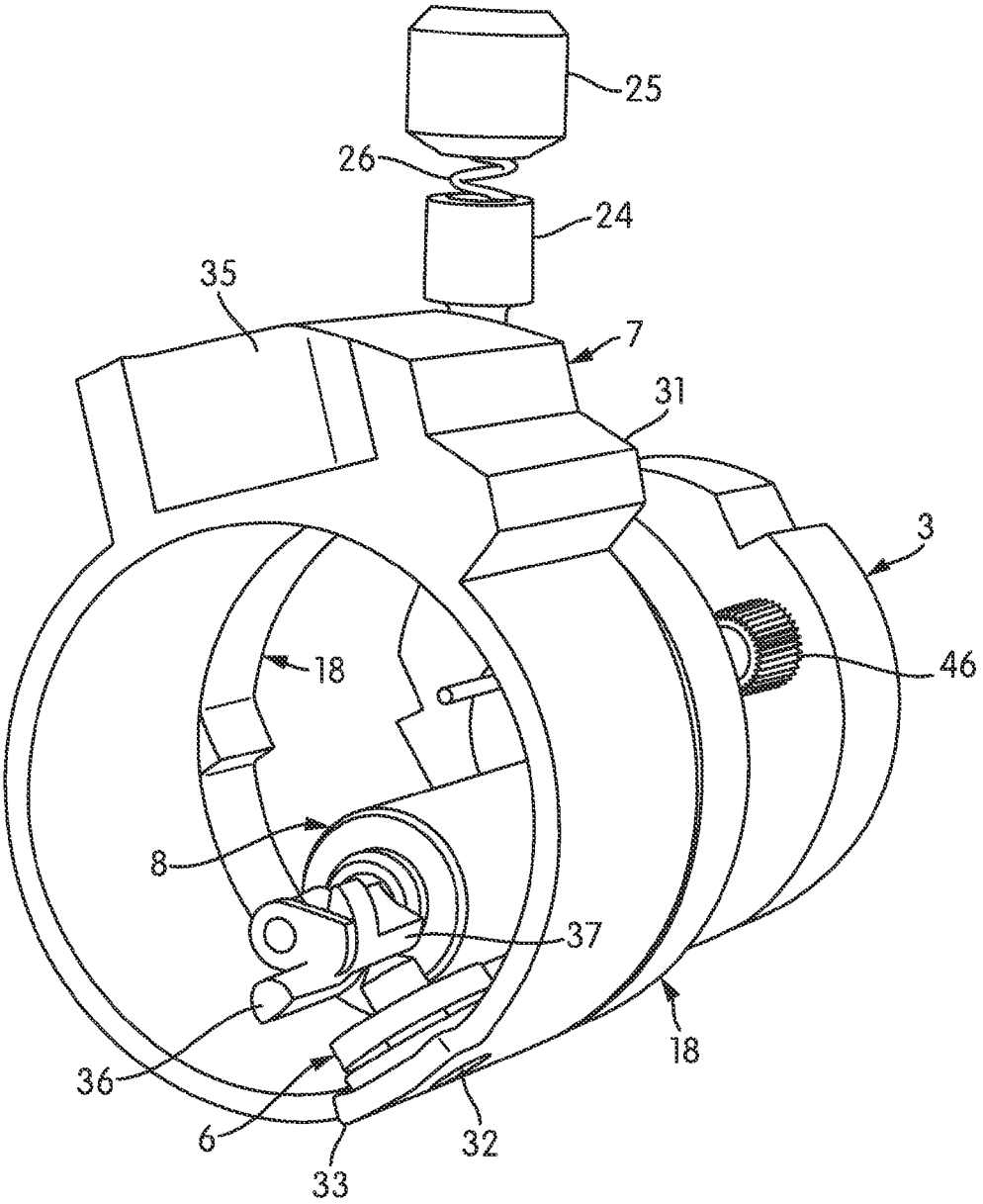
FIG. 9 is a rear perspective view with the shell, plug, and side bar omitted and showing the control sleeve in a retracted position.
Figure 11:
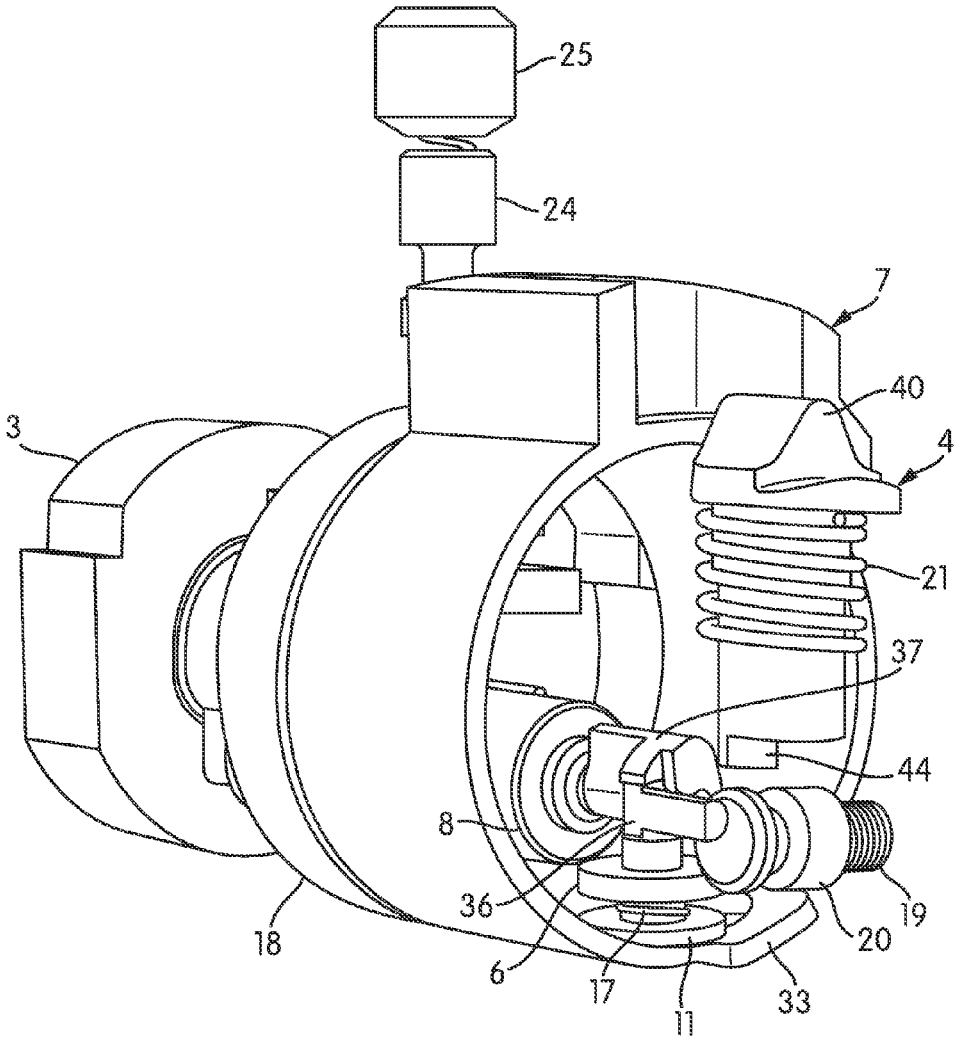
FIG. 11 is a rear perspective view with the shell and plug omitted, showing the control sleeve in an extended position and the side bar in a locked position.

An electronic key can be engaged with the contacts 12, 13, 14 through a key hole 28 formed in a front face of the shell 1. Locking and unlocking of the lock assembly 50 is effected by controlling the side bar 4 disposed within the plug 2. As shown in FIGS. 8 and 11, which are rear perspective views of the lock assembly 50 with the shell 1 and plug 2 omitted, the side bar 4 is arranged within the plug 2 in a generally radial orientation with the spring 21 urging side bar tip 40 radially outwardly into engagement with a groove (not shown) formed within the shell 1. As shown in FIG. 11, when in the locked condition, inward radial movement of the side bar 4 is prevented by a blocking pin 20 that is urged by blocking pin spring 19 into the blocking position shown in FIG. 11. With the side bar extended so that the side bar tip 40 extends within the groove of the shell 1, rotation of the plug 2 is prevented. When a properly programmed key is inserted into the key hole 28 to engage the contacts 12, 13, 14, a motor assembly 8 that is controlled by the PCB assembly 10 causes a blocking pin actuator 36 to rotate from a first position in FIG. 11 to a second position shown in FIG. 8. In the first position shown in FIG. 11, the blocking pin actuator 36 allows the blocking pin 20 to extend by the force of blocking pin spring 19 into a position that blocks radial inward movement of the side bar 4. When the motor assembly 8 rotates the blocking pin actuator 36 (counter-clockwise in the illustrated embodiment), the blocking pin actuator 36 contacts the blocking pin 20 and pushes it against the spring 19 to the position shown in FIG. 8. With the blocking pin 20 pushed to the second position shown in FIG. 8, the side bar 4 is allowed to move radially inwardly as torque is applied to the plug 2 to force the plug tip 40 from the internal groove within the shell 1, thereby allowing the plug 2 to be rotated.

Splined button 46 functions as an over-torque feature. If an unauthorized key or other instrument is inserted into the key hole 28 and twisted in an attempt to overcome the side bar 4, the button 46 will shear, thereby allowing the plug front 3 to rotate independently of the plug 2. With the plug front able to rotate independently of the plug 2, torque applied to the plug front 3 by an unauthorized key will not be transmitted to the plug 2.

The side bar 4, blocking pin 20, motor 8, and blocking pin actuator 36—along with the microprocessor—comprise components of an exemplary embodiment of an electronically-controlled plug locking mechanism configured to selectively permit or block rotation of the plug within the shell.

As noted, the illustrated lock assembly 50 is retained within a housing by means of the control sleeve 7 and the locking lug 31 of the control sleeve extending out of the shell 1 through the opening 29. To remove the lock assembly 50 from the housing, the control sleeve 7 must be rotated to retract the locking lug 31 into the shell 1. The control sleeve 7 is rotationally biased into the extended position by means of a bullet-nose pin 22 urged by a spring 23 against an angled camming recess 35 formed in the top rear surface of the control sleeve 7. The bullet-nose pin 22 is urged axially forwardly by the spring 23 and, by engagement with the camming recess 35, urges the control sleeve clockwise, as shown in FIGS. 9-13, to urge the locking lug 31 into the extended, locked position shown in FIGS. 11 and 13.

Figure 3:
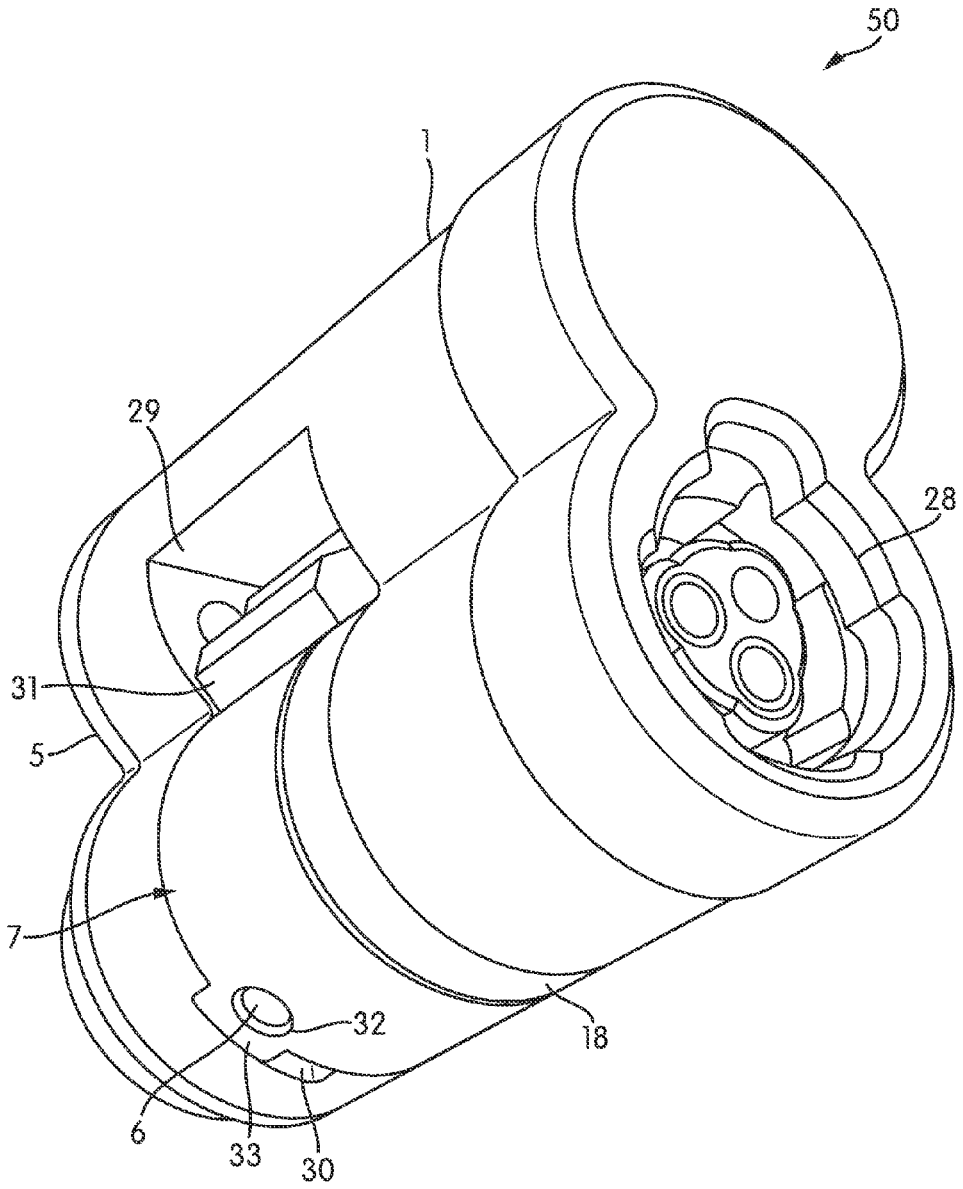
FIG. 3 is a bottom perspective view of the lock with the control sleeve retracted (key not shown for clarity).

The lock assembly 50 may be removed from a housing using a properly programmed control key. When a properly programmed and authenticated control key is presented, first, the motor assembly 8 rotates the locking pin actuator 36 into contact with the blocking pin 20, thereby allowing the side bar 4 to move axially inwardly into a retracted position as torque is applied to the plug 2, thereby permitting the plug to be rotated. After the locking pin actuator 36 rotates into contact with the locking pin 20, the plug 2 is partially rotated to drive the side bar tip 40 out of the internal groove formed in the shell 1 and push the side bar 4 down. The motor assembly 8 then reverses direction, and rotates a control pin actuator 37 into contact with a control pin 6 that is biased radially inwardly by a telescoping spring 17 disposed between a shoulder of the pin 6 and a washer 11 (see FIGS. 9-13). Although the reverse rotation of the motor 8 also moves the blocking pin actuator 36 out of contact with the blocking pin 20, the blocking pin 20 is prevented from returning to its blocking position by a side bar leg 44 extending from the bottom of the side bar 4 (see FIG. 8). Rotation of the control pin actuator 37 pushes the control pin 6 radially outwardly, so that the control pin, which is rotatable with the plug 2, will engage a control pin hole 32 formed in the control sleeve 7 when the plug 2 is rotated to align the control pin 6 with the control pin hole 32. With the control pin 6 engaged into the hole 32 of the control sleeve 7, the control sleeve 7 becomes coupled to the plug 2, so that rotation of the plug 2 will also rotate the control sleeve 7, thereby permitting the locking lug 31 to be retracted. The amount of rotation of the control sleeve 7 is limited by means of a hard stop projection 33 extending from the control sleeve 7 and engaged with a rectangular cut-out 30 formed adjacent the control sleeve slot 29 in the shell 1. This is illustrated by comparison of FIGS. 3 and 5.

The motor 8, control pin 6, control pin actuator 37, and the control pin hole 32—along with the microprocessor—comprise components of an exemplary embodiment of an electronically-controlled control element coupling mechanism configured to electronically control coupling of the control element, such as control sleeve 7, to the plug 2.

Figure 6:
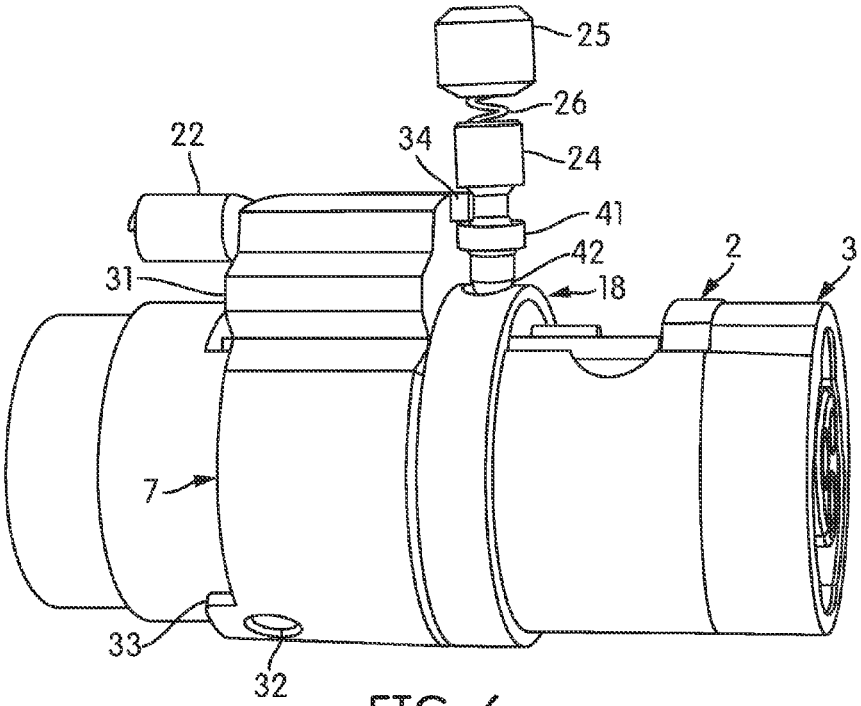
FIG. 6 is a side perspective view of the lock with the shell omitted and showing the control sleeve in the retracted position.
Figure 7:
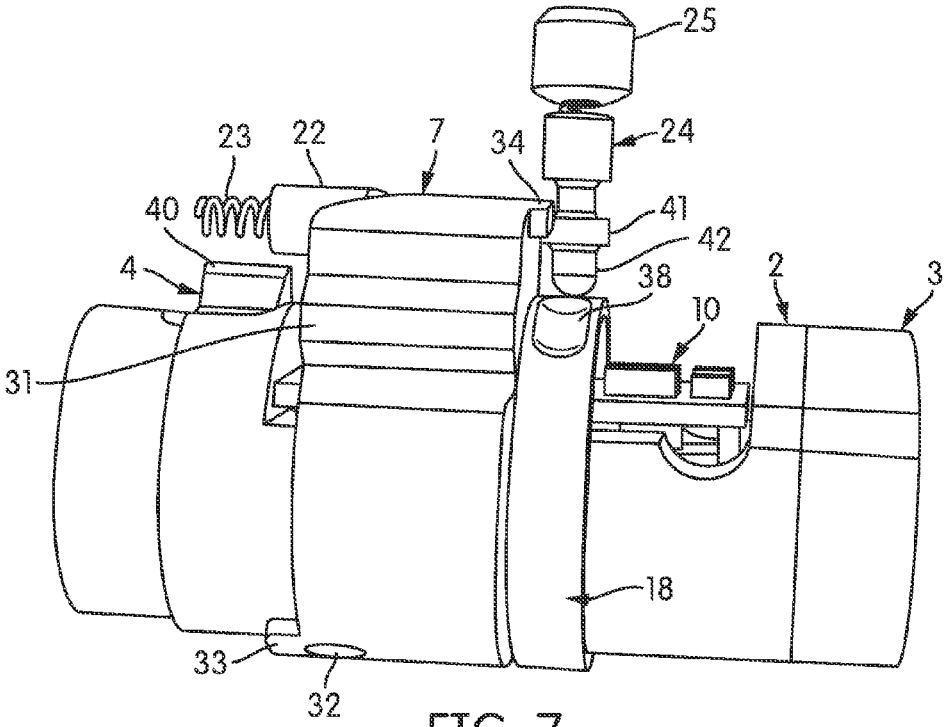
FIG. 7 is a side perspective view of the lock with the shell omitted and showing the control sleeve in an extended position.

In one embodiment, the lock assembly 50 includes a secondary feature for blocking rotation of the control sleeve 7, which is known as a "dead-latch feature." This feature comprises the latch pin control collar 18 having a latch pin recess, or relief area, 38 formed therein and a latch pin 24 that is biased radially inwardly by a spring 26. The latch pin 24 and spring 26 are is secured within the shell 1 by a set screw 25. The latch pin 24 includes a blocking collar 41 that, when in the position shown in FIG. 7, engages a blocking lug 34 extending from the control sleeve 7, thereby preventing control sleeve 7 from being rotated into a retracted position. Rotation of the collar 18 into the position shown in FIG. 6 causes the latch pin tip 42 of the latch pin 24 to extend into the latch pin recess 38 of the collar 18, as urged by the spring 26. With the latch pin 24 moved into this second position, as shown in FIG. 6, the blocking lug 34 of the control sleeve 7 is no longer engaged with the blocking collar 41 of the latch pin 24, and the control sleeve 7 is thereby allowed to rotate into a retracted position.

The method described above to retract the control sleeve 7 and remove the core assembly 50 from the housing requires the user to initially rotate the cylinder plug 2 partially toward the unlock position. This operation rotates the latch pin control collar 18, by means of the plug 2 engaging radial projections 39 (see FIGS. 10, 12, 13) projecting radially inwardly from the inner circumference of the collar 18, so that the spring loaded latch pin 24 extends into the relief area 38 of the collar 18, thereby moving the blocking collar 41 on the latch pin 24 out of the path of the blocking lug 34 on the control sleeve 7. This feature releases the control sleeve 7 to allow it to rotate with the plug 2 once the control pin 6 is engaged in the control pin hole 32 in the control sleeve 7, as described previously.

The operation is only momentary. When power is lost by removing the key, the control pin actuator 37 resets and allows the control pin 6 to be reset by its spring 17 back inside the plug 2, and the latch pin 24 is reset by its spring 26 after collar 18 is rotated back to the position of FIG. 7, to prevent rotation of the control sleeve 7.

The latch pin 24 serves as a deadlatch security feature of the plug 2 to prevent manipulation of the control sleeve 7 by applying direct pressure to the control sleeve 7 and retracting it.

Figure 14:
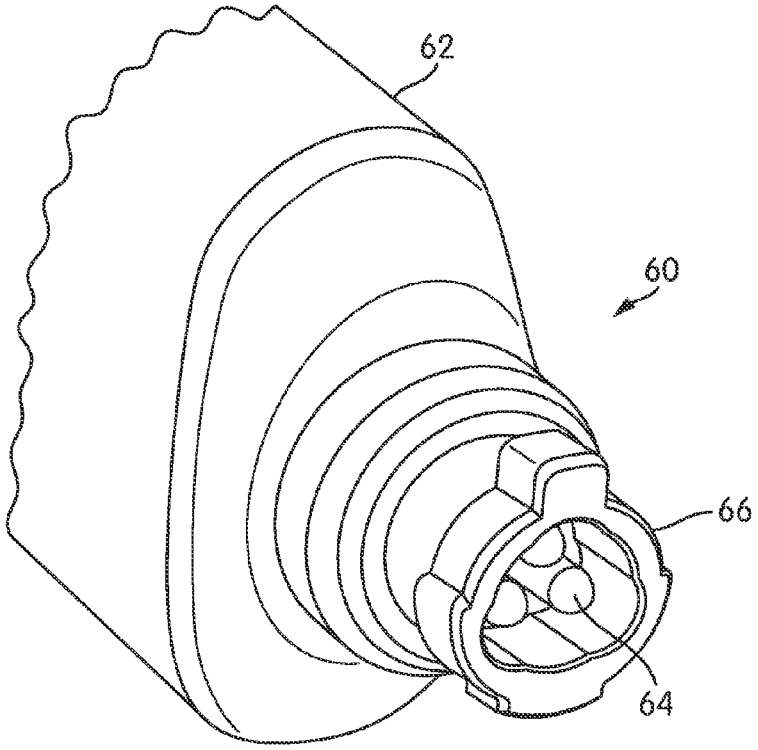
FIG. 14 is a partial perspective view of a key configured to operable in an electronically-controlled removable core lock embodying aspects of the present invention.
Figure 15:
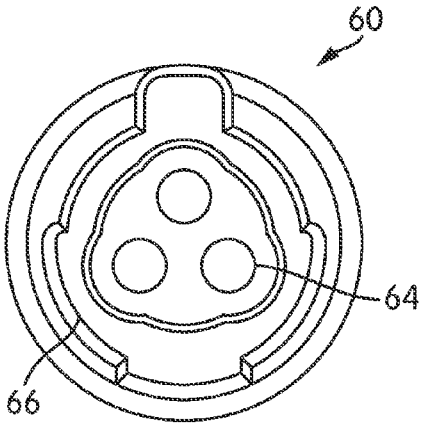
FIG. 15 is an end view of the key with the key body omitted from the drawing.

A key 60 configured for use with the lock assembly 50 is shown in FIGS. 14 and 15. The key 60 includes a body 62 and a keyway projection 66 (the key body 62 is omitted from FIG. 15). The keyway projection 66 is configured to be inserted into the key hole 28 and defines an annular closed structure having an exterior shape that conforms to the shape of the key hole 28 and an interior shape that conforms to corresponding structure in the plug front 3. The key 60 further includes three pins, or contact elements, 64 configured to engage the contacts 12, 13, 14 of the lock 50.

The key includes a microcontroller disposed within the body 62. The microcontroller of the key 60 may comprise a microprocessor in communication with memory, such as electronically erasable programmable read only memory (EEPROM) and is associated with functions related to the operation of the lock 50 and key 60, such as, comparing information, executing algorithms to effect operation of the lock, and storing information relating to authorization codes (e.g., control or access credentials), passwords, lock activation events (e.g., audit events, such as entry and core removal), and other data. The microcontroller of the key 60 communicates with the microcontroller of the lock 50 via contact between the pins 64 of the key 60 with the contacts 12, 13, 14 of the lock 50. During such communication, data and power are exchanged between the key 60 and lock 50.

A key 60 and lock 50 have a unique authorization, or identification, codes programmed in the memories of the respective microcontrollers. When the key projection 66 is inserted into the key hole 28, the key microcontroller sends an authentication code to the lock microcontroller, and the lock microcontroller performs a comparison to determine if the key 60 is authorized to open the lock 50. If the key 60 is authorized to open the lock 50 (i.e., the key presents a valid access credential), the lock microcontroller and/or the key microcontroller sends a signal to the motor assembly 8 to actuate the blocking pin actuator 36 to move the blocking pin 20 (as described above), thereby allowing the side bar 4 to move down when torque is applied to the plug 2, and thus the lock 50 can be opened.

The key 60 may include an indicator such as a light (LED) and/or beeper that indicates the status of the key. For example, the indicator may shine green if the key is authorized to open a lock and red if the key is not authorized to open a lock.

The key 60 may be programmed to implement a hierarchical lock system, where some keys are programmed to open certain locks—perhaps only one lock—and other keys may be programmed as master keys, thereby able to open several—perhaps all—locks in the system.

The key 60 may also be programmed as a control key able to remove a removable core from its housing. When the key projection 66 of a key 60 programmed as a control key is inserted into the key hole 28, the key microcontroller sends an authentication code to the lock microcontroller. The lock microcontroller confirms that the key is an authorized control key (i.e., the key presents a valid control credential), and the lock microcontroller and/or the key microcontroller sends a signal to the motor assembly 8 to actuate the blocking pin actuator 36 to move the blocking pin 20 (as described above), thereby allowing the side bar 4 to move down when torque is applied to the plug 2, and thus the lock 50 can be opened. After the plug 2 has been partially rotated, the lock microcontroller and/or the key microcontroller sends a signal to the motor assembly 8 to actuate the control pin actuator 37 to apply an outward axial force to the control pin 6. A signal, such as a flashing LED on the key 60, may be provided to indicate to the user that the control pin actuator 37 has been activated to engage the control pin 6. The plug is then rotated in the opposite direction to align the control pin 6 with the control pin hole 32 to couple the control sleeve 7 to the plug 2. The plug 2 is then rotated back in the first direction to retract the sleeve 7, and the lock assembly 50 can be removed from its housing.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the inventions requires features or combinations of features other than those expressly recited in the claims. Accordingly, the present invention is deemed to include all modifications and variations encompassed within the spirit and scope of the following appended claims.

The invention claimed is:

1. An interchangeable, electromechanical lock core, comprising:

a shell;

a plug rotatably positioned within said shell;

an electronically-controlled plug locking mechanism configured to selectively permit or block rotation of said plug within said shell;

a control element configured for selective movement between a core lock position and a core release position, wherein when the control element is in the core lock position the lock core is held securely within a lock housing, and when the control element is in the core release position the lock core is removable from the lock housing; and an electronically-controlled control element coupling mechanism configured to electronically control a state of said control element, wherein, in a first state of said control element, said control element is operatively uncoupled from said plug and, in a second state of said control element, said control element is operatively coupled with said plug, and wherein the position of the control element is controlled by rotation of said plug when said control element is in the second state, wherein, upon presentation of a valid control credential, said electronically-controlled plug locking mechanism is electronically activated to permit rotation of said plug, and said electronically-controlled control element coupling mechanism is electronically activated to place said control element in the second state.

2. The interchangeable electromechanical lock core of claim 1, wherein said electronically-controlled plug locking mechanism comprises:

a side bar moveable between a locking position engaged with said shell to prevent rotation of said plug within said shell and an unlock position disengaged with said shell to permit said plug to rotate with respect to said shell;

a blocking pin configured to be moveable between a first position blocking movement of said side bar from said locking position to said unlock position and a second position permitting movement of said side bar from said locking position to said unlock position;

a motor controlled blocking pin actuator configured to move said blocking pin from said first position to said second position; and a microcontroller configured to transmit control signals to said motor controlled blocking pin actuator to cause said motor controlled blocking pin actuator to move said blocking pin from said first position to said second position.

3. The interchangeable electromechanical lock core of claim 1, wherein said control element comprises a control sleeve disposed within said shell and surrounding said plug and configured to be rotatable between a core lock position and a core release position.

4. The interchangeable electromechanical lock core of claim 3, wherein said electronically-controlled control element coupling mechanism comprises:

a control pin configured to be movable with said plug;

a motor-controlled control pin actuator configured to move between a first position disengaged from said control pin and a second position engaged with said control pin, wherein engagement of said motor-controlled control pin actuator with said control pin causes said control pin to extend into a control pin hole formed in said control sleeve when said plug is rotated to align said control pin with said control pin hole, and wherein extension of said control pin into said control pin hole rotationally couples said control sleeve to said plug so that rotation of said plug moves said control sleeve from the core lock position to the core release position; and a microcontroller configured to transmit control signals to said motor-controlled control pin actuator to cause said motor-controlled control pin actuator to move from said first position to said second position.

5. The interchangeable electromechanical lock core of claim 1, further comprising a dead-latch feature configured to be moved to a first position blocking movement of the control element into the core release position and a second position enabling movement of the control element into the core release position.

6. The interchangeable electromechanical lock core of claim 5, wherein the dead-latch feature comprises:

a latch pin control collar having a latch pin recess formed therein and rotatable between a first position and a second position; and a latch pin including a blocking collar, wherein the latch pin is in contact with the latch pin control collar and is moveable between a first position with a tip thereof not engage with the latch pin recess and a second position with the tip thereof engaged with the latch pin recess, wherein when the dead-latch feature is in the first position, the latch pin is in the first position and the blocking collar engages a blocking lug extending from the control element, thereby preventing movement of the control element into the core release position and when the dead-latch feature is in the second position, the latch pin is in the second position and the blocking lug of the control element is no longer engaged with the blocking collar of the latch pin, and the control element is thereby allowed to move into the core release position, and wherein the latch pin is in its first position when the latch pin control collar is in its first position, and the latch pin is in its second position with the tip thereof engaged in the latch pin recess, when the latch pin control collar is in its second position.

7. The interchangeable electromechanical lock core of claim 3, wherein said a control sleeve includes a an angled camming recess; and said electromechanical lock core further comprises a bullet-nose pin urged by a spring against the angled camming recess to urge the control sleeve into a core lock position.

8. The interchangeable electromechanical lock core of claim 2, wherein said control element comprises a control sleeve disposed within said shell and surrounding said plug and configured to be rotatable between a core lock position and a core release position.

9. The interchangeable electromechanical lock core of claim 8, wherein said electronically-controlled control element coupling mechanism comprises:

a control pin configured to be movable with said plug;

a motor-controlled control pin actuator configured to move between a first position disengaged from said control pin and a second position engaged with said control pin, wherein engagement of said motor-controlled control pin actuator with said control pin causes said control pin to extend into a control pin hole formed in said control sleeve when said plug is rotated to align said control pin with said control pin hole, and wherein extension of said control pin into said control pin hole rotationally couples said control sleeve to said plug so that rotation of said plug moves said control sleeve from the core lock position to the core release position; and a microcontroller configured to transmit control signals to said motor-controlled control pin actuator to cause said motor-controlled control pin actuator to move from said first position to said second position.

10. The interchangeable electromechanical lock core of claim 9, wherein a single motor controls said motor controlled blocking pin actuator and said motor-controlled control pin actuator.

11. The interchangeable electromechanical lock core of claim 9, wherein said microcontroller is further configured to receive an authentication code and confirm that the authentication code presents a valid control credential.

12. The interchangeable electromechanical lock core of claim 11, wherein said microcontroller is further configured to distinguish between a first valid control credential that enables activation of only said motor controlled blocking pin actuator and a second valid control credential that enables activation of both said motor controlled blocking pin actuator and said motor-controlled control pin actuator.

13. An interchangeable, electromechanical lock core, comprising:

a shell;

a plug rotatably positioned within said shell;

an electronically-controlled plug locking mechanism configured to selectively permit or block rotation of said plug within said shell;

a control element configured for selective movement between a core lock position and a core release position, wherein when the control element is in the core lock position the lock core is held securely within a lock housing, and when the control element is in the core release position the lock core is removable from the lock housing;

an electronically-controlled control element coupling mechanism configured to electronically control a state of said control element, wherein, in a first state of said control element, said control element is operatively uncoupled from said plug and, in a second state of said control element, said control element is operatively coupled with said plug, and wherein the position of the control element is controlled by rotation of said plug when said control element is in the second state; and a microcontroller configured to distinguish between a first valid control credential and a second valid control credential, wherein the first valid control credential enables activation of only said electronically-controlled plug locking mechanism so as to permit rotation of said plug within said shell and the second valid control credential enables activation of both said electronically-controlled plug locking mechanism so as to permit rotation of said plug within said shell and said electronically-controlled control element coupling mechanism so as to change the status of said control element from said first state to said second state.

14. An electronic, interchangeable core lock system comprising:

a core with electronically-controlled locking features configured to lock the core within a housing;

an electronically operable lock within the core;

at least one key electronically programmed to operate only as a user key able to operate the lock; and at least one key electronically programmed to operate as a control key able to both operate the lock and to actuate the locking features of the core.

15. A key configured to operate an interchangeable, electromechanical lock core that comprises a shell, a plug rotatably positioned within the shell, an electronically-controlled plug locking mechanism configured to selectively permit or block rotation of the plug within the shell, and a control element configured for selective movement between a core lock position and a core release position, wherein when the control element is in the core lock position the lock core is held securely within a lock housing, and when the control sleeve is in the core release position the lock core is removable from the lock housing, said key comprising:

contact elements configured to engage contacts of the electromechanical lock core and transmit signals between the key and the electromechanical lock core; and programmable memory programmed with executable instructions configured to:

transmit signals to the lock that will activate the electronically-controlled plug locking mechanism to permit rotation of the plug; and transmit signals to the lock that will enable the control element to be moved from the core lock position to the core release position.

* * * * *